US006305383B1

(12) United States Patent
Thoma

(10) Patent No.: US 6,305,383 B1
(45) Date of Patent: Oct. 23, 2001

(54) METHOD FOR REMOVING ACRYLIC FINGERNAILS

(76) Inventor: Marlene I. Thoma, 4972 NW. 95th Ave., Apt. 9C, Sunrise, FL (US) 33351

( * ) Notice: Subject to any disclaimer, the term of this patent is extended or adjusted under 35 U.S.C. 154(b) by 0 days.

(21) Appl. No.: 09/661,074

(22) Filed: Sep. 13, 2000

Related U.S. Application Data

(60) Provisional application No. 60/153,527, filed on Sep. 13, 1999.

(51) Int. Cl.[7] ..... A45D 29/18

(52) U.S. Cl. ..... 132/200; 132/73; 132/74.5

(58) Field of Search ..... 132/200, 73, 74.5, 132/286, 73.5; 2/159, 160, 163, 164

(56) References Cited

U.S. PATENT DOCUMENTS 4,938,347 * 7/1990 Tillman ..... 132/73
5,093,933 * 3/1992 Berry ..... 2/163
5,806,536 * 9/1998 Tietjen ..... 132/73

* cited by examiner

*Primary Examiner*—Todd E. Manahan
(74) *Attorney, Agent, or Firm*—Joseph N. Breaux

(57) ABSTRACT

A method and apparatus for removing artificial acrylic finger nails. The apparatus is a kit including a number of cotton balls or pads, a number of rubber finger covers, at least one surgical rubber or latex gloves, and a small quantity of acetone. In the method of the present invention, the user simply wets a cotton ball or pad with the acetone and places it onto the top of a fingernail. One of the ten finger covers is then put over the finger tip and acetone soaked cotton ball or pad. This procedure is then repeated for the remaining digits requiring removal of an artificial acrylic nail. Once this is accomplished, each hand having an artificial acrylic nail removed is placed into one of the two surgical type rubber or latex gloves.

1 Claim, 3 Drawing Sheets

METHOD FOR REMOVING ACRYLIC FINGERNAILS

This application claims benefit of provisional No. 60/153,527 filed Sep. 13, 1999.

TECHNICAL FIELD

The present invention is that of a newly designed apparatus and method for removing artificial acrylic fingernails. The apparatus is in the form of a kit including ten cotton balls or pads, ten rubber finger covers, two surgical rubber or latex gloves, and a small bottle of acetone.

BACKGROUND ART

Presently, artificial acrylic fingernails must be soaked in acetone to soften adhesive on each nail for removal. Individual nails must be removed for replacement when damaged, and all nails must be removed and replaced periodically. Soaking the finger or fingers in acetone causes two problems. One is fume, which are extremely strong and irritating, and the other is that the person undergoing the procedure is basically immobilized while the soaking processes are occurring.

GENERAL SUMMARY DISCUSSION OF INVENTION

As described herein before, the apparatus is a kit including ten cotton balls or pads, ten rubber finger covers, two surgical rubber or latex gloves, and a small bottle of acetone. In the method of the present invention, the user simply wets a cotton ball or pad with the acetone and places it onto the top of a fingernail. One of the ten finger covers is then put over the finger tip and acetone soaked cotton ball or pad. This procedure is then repeated for the remaining digits requiring removal of an artificial acrylic nail. Once this is accomplished, each hand having an artificial acrylic nail removed is placed into one of the two surgical type rubber or latex gloves.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
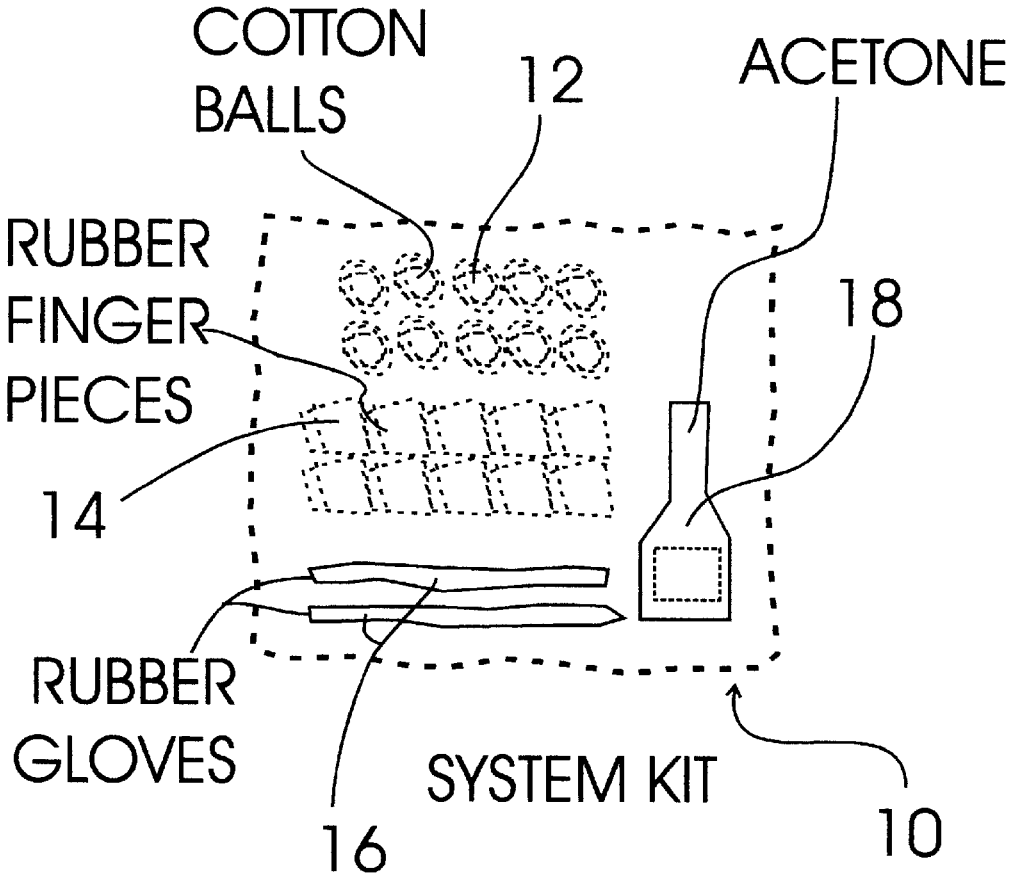
FIG. 1 is a top plan view of an exemplary embodiment of the apparatus of the present invention.

FIG. 1 shows an exemplary embodiment of the apparatus for removing artificial acrylic fingernails generally designated 10. The apparatus 10 is in the form of a kit including ten cotton balls 12, ten rubber finger covers 14, two surgical latex gloves 16, and a small bottle of acetone 18.

Figure 2:
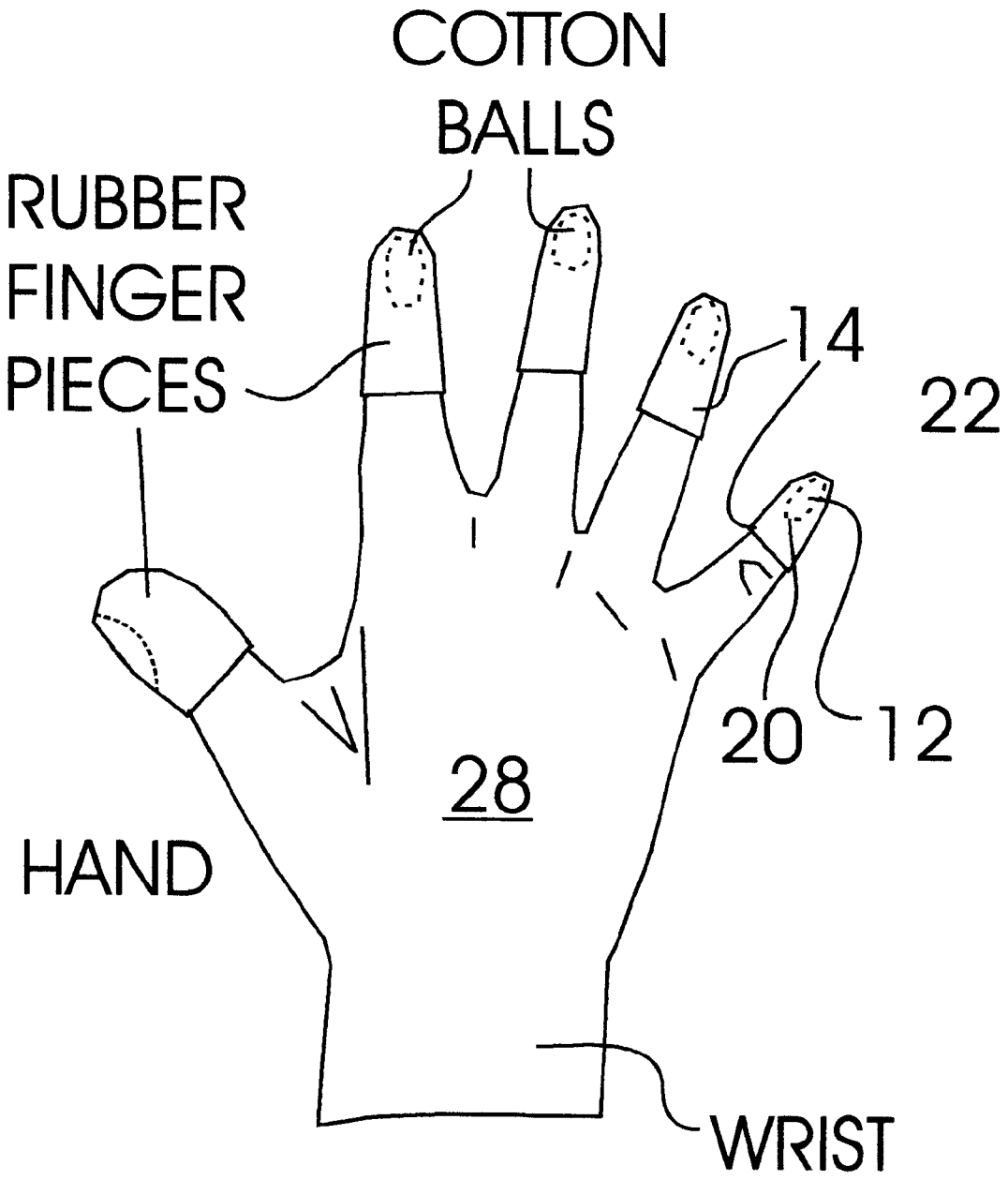
FIG. 2 is a top plan view showing a hand of a user having the acetone soaked cotton pads placed over each of the five digits of the hand wherein each digit and cotton pad is covered with a separate rubber finger cover.
Figure 3:
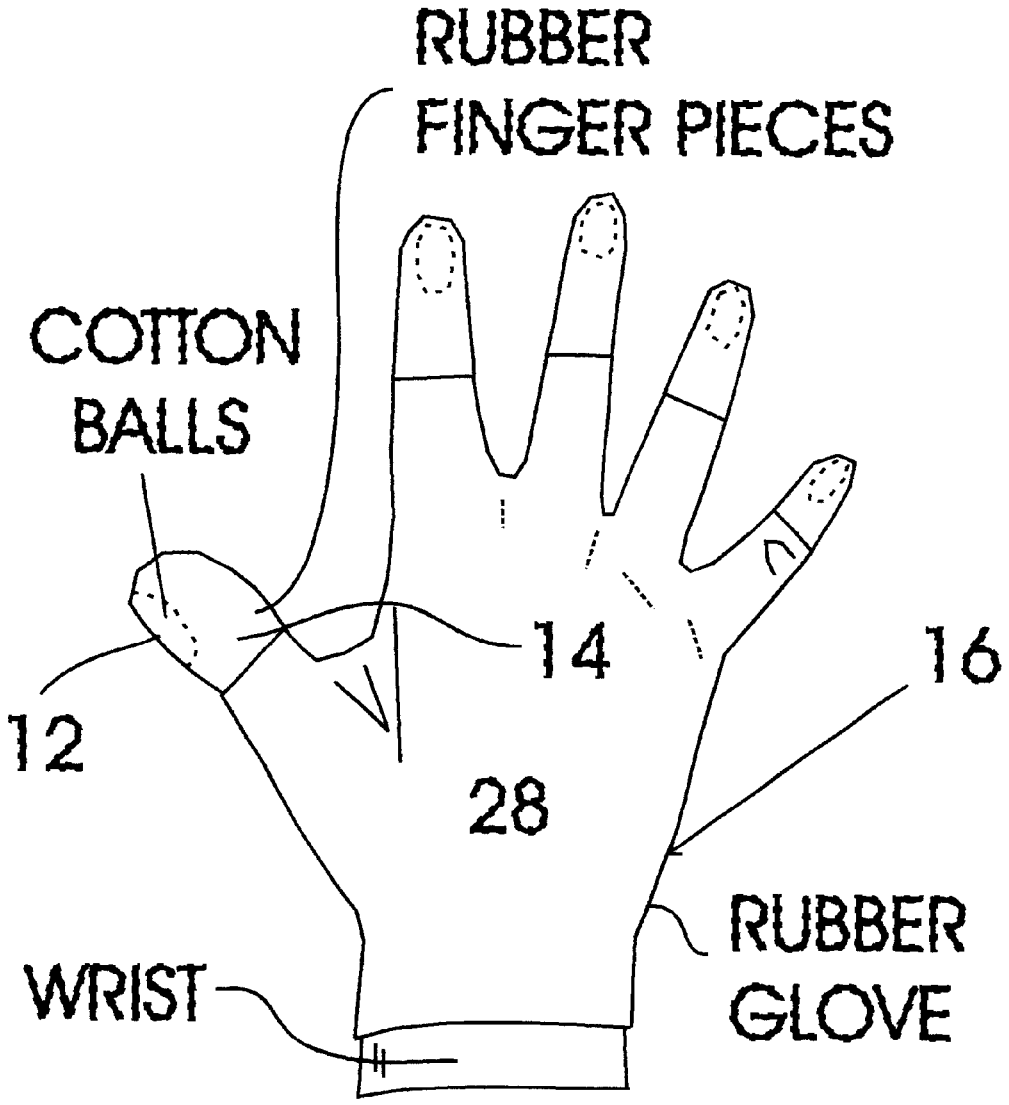
FIG. 3 is a top plan view of the hand of FIG. 1 further including one of the surgical rubber or latex gloves pulled over the hand.

With reference now also to FIGS. 2 and 3, an exemplary method for removing artificial acrylic fingernails is now described. In the method of the present invention, the user simply wets a cotton ball 12 with the acetone 18 and places it onto the top of a fingernail 20 on the finger tip 22 of the persons hand 28. One of the ten finger covers 14 is then put over the finger tip 22 and the fingernail 20 covered with acetone soaked cotton ball 12. This procedure is then repeated for the remaining digits of fingers of hand 28 for those digits or fingers requiring removal of an artificial acrylic nail. Once this is accomplished, each hand 28 that is having an artificial acrylic nail removed is placed into one of the two latex gloves 16.

The user enjoys the benefit of being able to apply acetone to the nail without the hassle of having to sit with the fingers soaking in a vat of the liquid, allowing the user to participate in other activities such as reading a magazine or having a pedicure. In addition, the pair of gloves keeps strong fumes from the acetone from polluting the air. If desired, a user could apply the chemical to their fingernails while at home, prior to going to the salon, so that the nails would be ready for removal upon arrival.

Use of the present invention would provide a mechanism for applying acetone to the nails while being free to do other activities simultaneously, with the added benefit of having a greatly reduced problem from irritating fumes. This apparatus and method would also save time, as the user cold begin the acetone application while on the way to the nail salon, so the nails would be ready for removal upon arrival. The elements of the apparatus including the cotton balls 12, rubber finger tips 14, gloves 16, and acetone 18 could be sold in bulk for practicing the method in commercial salons.

It can be seen from the preceding description that a apparatus and method for removing acrylic fingernails has been provided.

It is noted that the embodiment of the apparatus and method for removing acrylic fingernails described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirement of the law, it is to be understood that the details herein are to be interpreted as illustrative and not in a limiting sense.

What is claimed is:

1. A method for removing acrylic fingernails comprising the steps of:

a) proving a number of acrylic fingernail removal elements including a cotton member, a finger cover, a fluid impermeable glove; and a quantity of acetone; b) wetting said cotton member with said acetone and placing said acetone wetted cotton member onto a top of an artificial acrylic fingernail secured to the tip of a person's finger; c) positioning a finger cover over the finger tip having the artificial acrylic fingernail covered said acetone wetted cotton member; and d) positioning the hand with the finger cover over the finger tip having the artificial acrylic fingernail covered said acetone wetted cotton member into the fluid impermeable glove.

* * * * *